US007856307B2

(12) United States Patent
Ito et al.

(10) Patent No.: US 7,856,307 B2
(45) Date of Patent: Dec. 21, 2010

(54) FUEL INJECTION CONTROL DEVICE AND METHOD FOR MULTI-FUEL ENGINE

(75) Inventors: Atsushi Ito, Wako (JP); Yoichi Takahashi, Wako (JP); Hideya Horie, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/562,135

(22) Filed: Sep. 18, 2009

(65) Prior Publication Data

US 2010/0101548 A1 Apr. 29, 2010

(30) Foreign Application Priority Data

Oct. 29, 2008 (JP) ..... 2008-278518

(51) Int. Cl.
*F02D 41/30* (2006.01)

(52) U.S. Cl. ..... 701/109; 123/674

(58) Field of Classification Search ..... 123/674, 123/480, 486, 491, 492; 701/103–105, 109, 701/113

See application file for complete search history.

(56) References Cited

U.S. PATENT DOCUMENTS 7,650,874 B2 * 1/2010 Takubo ..... 123/434
2008/0270005 A1 * 10/2008 Tooyama ..... 701/103
2009/0082947 A1 * 3/2009 Tashima ..... 701/109
2009/0105931 A1 * 4/2009 Asama ..... 701/104
2009/0306879 A1 * 12/2009 Takubo ..... 701/104
2010/0049425 A1 * 2/2010 Tashima et al. ..... 701/109

FOREIGN PATENT DOCUMENTS

JP 2004-293491 10/2004

* cited by examiner

*Primary Examiner*—Hai H Huynh
(74) *Attorney, Agent, or Firm*—Ditthavong Mori & Steiner, P.C.

(57) ABSTRACT

A fuel injection control device for a multi-fuel engine includes a corrector and a reviewer. An alcohol concentration learning unit is provided to learn an alcohol concentration in an injected fuel based on an oxygen concentration detected in an exhaust gas. A fuel injection amount controller is provided to control a fuel injection amount based on a learning value corresponding to the oxygen concentration. The corrector is configured to reduce the fuel injection amount corresponding to the learning value for a predetermined time period when the learning value is higher than a threshold value when an engine is started. The reviewer is configured to review the learning value to provide a revised learning value based on the oxygen concentration while the corrector reduces the fuel injection amount. The fuel injection amount is controlled based on the revised learning value after the corrector reduces the fuel injection amount.

9 Claims, 14 Drawing Sheets

ΣTout= INTEGRAL OF INJECTED AMOUNT

Tout_ref = FUEL SWITCHING THRESHOLD VALUE

FUEL INJECTION CONTROL DEVICE AND METHOD FOR MULTI-FUEL ENGINE

CROSS-REFERENCE TO RELATED APPLICATIONS

The present application claims priority under 35 U.S.C. §119 to Japanese Patent Application No. 2008-278518, filed Oct. 29, 2008. The contents of this application are incorporated herein by reference in their entirety.

BACKGROUND OF THE INVENTION

1. Field of the Invention

The present invention relates to a fuel injection control device for a multi-fuel engine and a fuel injection control method for the multi-fuel engine.

2. Discussion of the Background

In recent years, alcohol fuels have shown promise as an alternative to fossil fuels from the point of view of environmental protection. FFV's (FFV: Flexible Fuel Vehicles) capable of travelling even on an alcohol fuel mixture that is a mixture of alcohol and gasoline, in addition to travelling on just gasoline, are being developed. In addition to the calorific value and the vaporization characteristics being different compared to fuel that is 100% gasoline, an alcohol/fuel mixture has different characteristics depending on the alcohol concentration indicating a mixing ratio with respect to gasoline. This means that when an alcohol fuel mixture is used in an engine for which the use of fuel that is 100% gasoline is assumed, a controlled fuel-air ratio departs from a theoretical fuel air ratio, so that an exhaust component increases or operability changes. Regarding this kind of technological problem, technology is disclosed in Japanese Patent Publication Laid-open No. 2004-293491 for obtaining the same equivalence ratio by correcting an amount of fuel injected to an engine according to an alcohol concentration of alcohol/fuel mixture.

With an FFV, the concentration of oxygen within the exhaust gas while the vehicle is travelling is detected by an oxygen concentration sensor. Alcohol concentration within the fuel is then repeatedly learned based on the results of this detection and the amount of fuel injected is controlled based on the learning results. The learning results for the alcohol concentration are then repeatedly updated in memory. When a main switch is then turned off and then subsequently turned on again, learning results for the alcohol concentration for the previous time are read out from the memory. The amount of fuel injected can be controlled on the assumption that the fuel is of the alcohol concentration of the learned results.

With the above conventional technology, when fuel of a different alcohol concentration is supplied after the main switch is turned off, the next time the engine is started the learning results for the alcohol concentration and the actual alcohol concentration will be different.

The composition of ethanol contains oxygen atoms. The amount of oxygen per unit volume required for combustion can therefore be small compared to the combustion of gasoline. The amount of fuel injected is also increased as the alcohol concentration is increased in order to obtain the same equivalence ratio. When the actual alcohol concentration is lower than the alcohol concentration for the learned results, accidental firing occurs due to the air/fuel ratio being too rich and the load on the catalyzer therefore becomes substantial.

SUMMARY OF THE INVENTION

According to one aspect of the present invention, a fuel injection control device for a multi-fuel engine includes an oxygen concentration sensor, an alcohol concentration learning unit, an alcohol concentration memory, a fuel injection amount controller, a corrector, and a reviewer. The oxygen concentration sensor is configured to detect an oxygen concentration in an exhaust gas. The alcohol concentration learning unit is configured to learn an alcohol concentration in an injected fuel based on the oxygen concentration detected by the oxygen concentration sensor. The alcohol concentration memory is configured to store a learning value corresponding to the oxygen concentration. The fuel injection amount controller is configured to control a fuel injection amount based on the learning value. The corrector is configured to reduce the fuel injection amount corresponding to the learning value for a predetermined time period when the learning value is higher than a threshold value when an engine is started. The reviewer is configured to review the learning value to provide a revised learning value based on the oxygen concentration while the corrector reduces the fuel injection amount. The fuel injection amount is controlled based on the revised learning value after the corrector reduces the fuel injection amount.

According to another aspect of the present invention, a fuel injection control method for a multi-fuel engine includes detecting an oxygen concentration in an exhaust gas. An alcohol concentration in an injected fuel is learnt based on the oxygen concentration. A learning value corresponding to the oxygen concentration is stored. A fuel injection amount is controlled based on the learning value. The fuel injection amount corresponding to the learning value is reduced for a predetermined time period when the learning value is higher than a threshold value when an engine is started. The learning value is reviewed to provide a revised learning value based on the oxygen concentration while the fuel injection amount is reduced. The fuel injection amount is controlled based on the revised learning value after the fuel injection amount is reduced.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
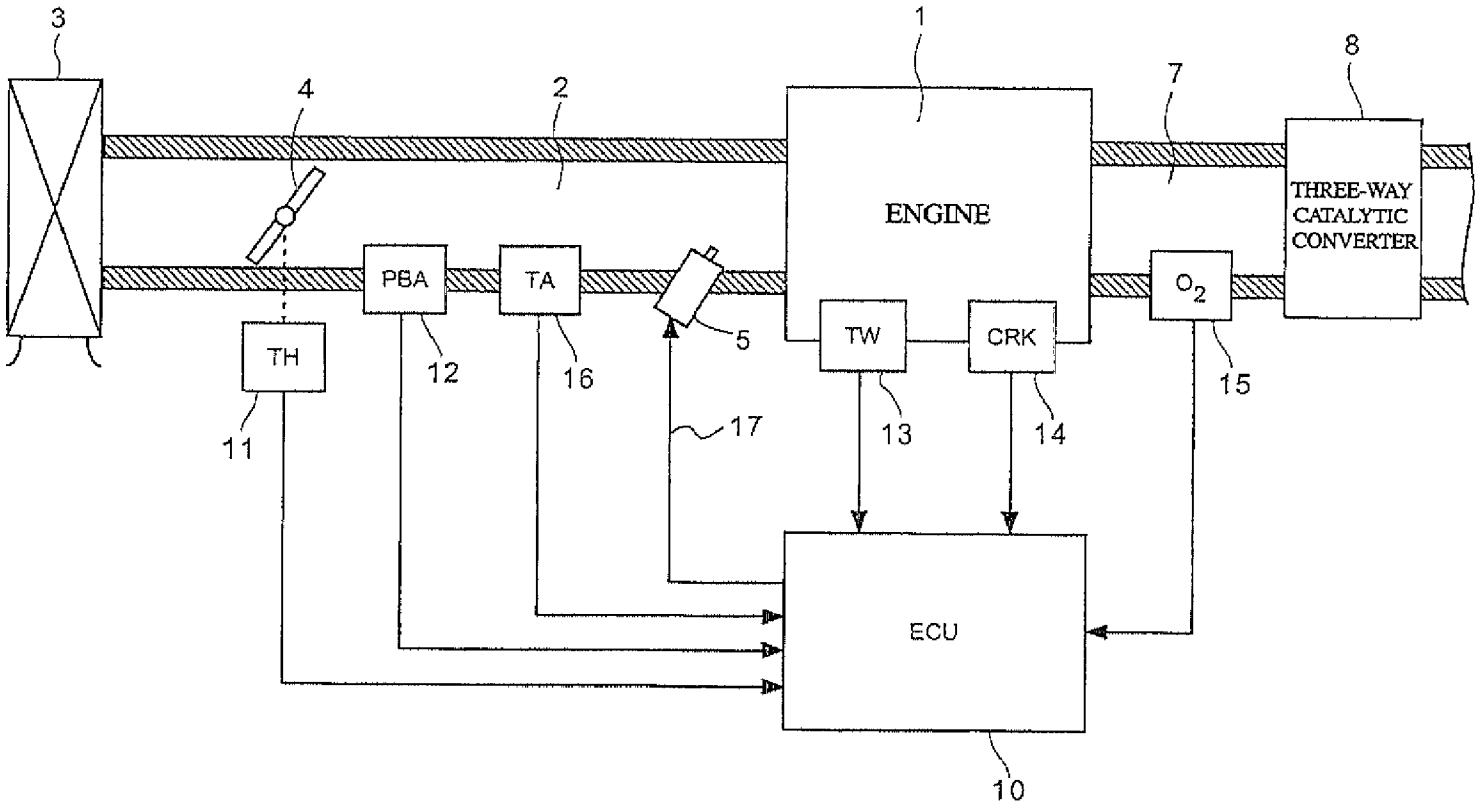
FIG. 1 is a diagram of an internal combustion engine and a fuel injection control system thereof of an embodiment of the present invention.

The embodiments will now be described with reference to the accompanying drawings, wherein like reference numerals designate corresponding or identical elements throughout the various drawings.

FIG. 1 is a diagram showing an overall configuration for an internal combustion engine and a fuel injection control system of an embodiment of the present invention.

An intake pipe 2 and an exhaust pipe 7 are coupled to an engine 1. An air cleaner 3 is provided on the upstream side of the intake pipe 2. An amount of air taken into the engine 1 can be adjusted by a throttle valve 4 arranged within the intake pipe 2. An extent of opening of the throttle valve 4 can be detected by a throttle opening sensor (hereinafter denoted as a TH sensor) 11.

An intake pipe absolute pressure sensor (expressed in the following as PBA sensor) 12 measures intake pipe absolute pressure PBA. An intake air temperature sensor (expressed as "TA sensor" in the following) 16 measures intake air temperature TA within the intake pipe 2. A water temperature sensor (hereinafter expressed as "TW sensor") 13 measures a circulating water temperature TW of the engine 1. A crank angle sensor (hereinafter expressed as "CRK sensor") 14 measures a crank angle CRK that represents a crank position of the engine 1.

A three-way catalytic converter 8 is provided on the downstream side of the exhaust pipe 7. An oxygen concentration sensor (hereinafter referred to as an $O_2$ sensor) 15 for measuring oxygen concentration within the exhaust gas within the exhaust pipe 7 is provided between the engine 1 of the exhaust pipe 7 and the three-way catalytic converter 8. An Engine Control Unit (ECU) 10 executes various types of engine control including the control of fuel injection based on detection signals outputted by each of the sensors. An injector 5 opens a valve that opens in response to an injection control signal outputted by the ECU 10 and injects a fuel mixture of gasoline or gasoline and alcohol (in this embodiment, ethanol).

Figure 2:
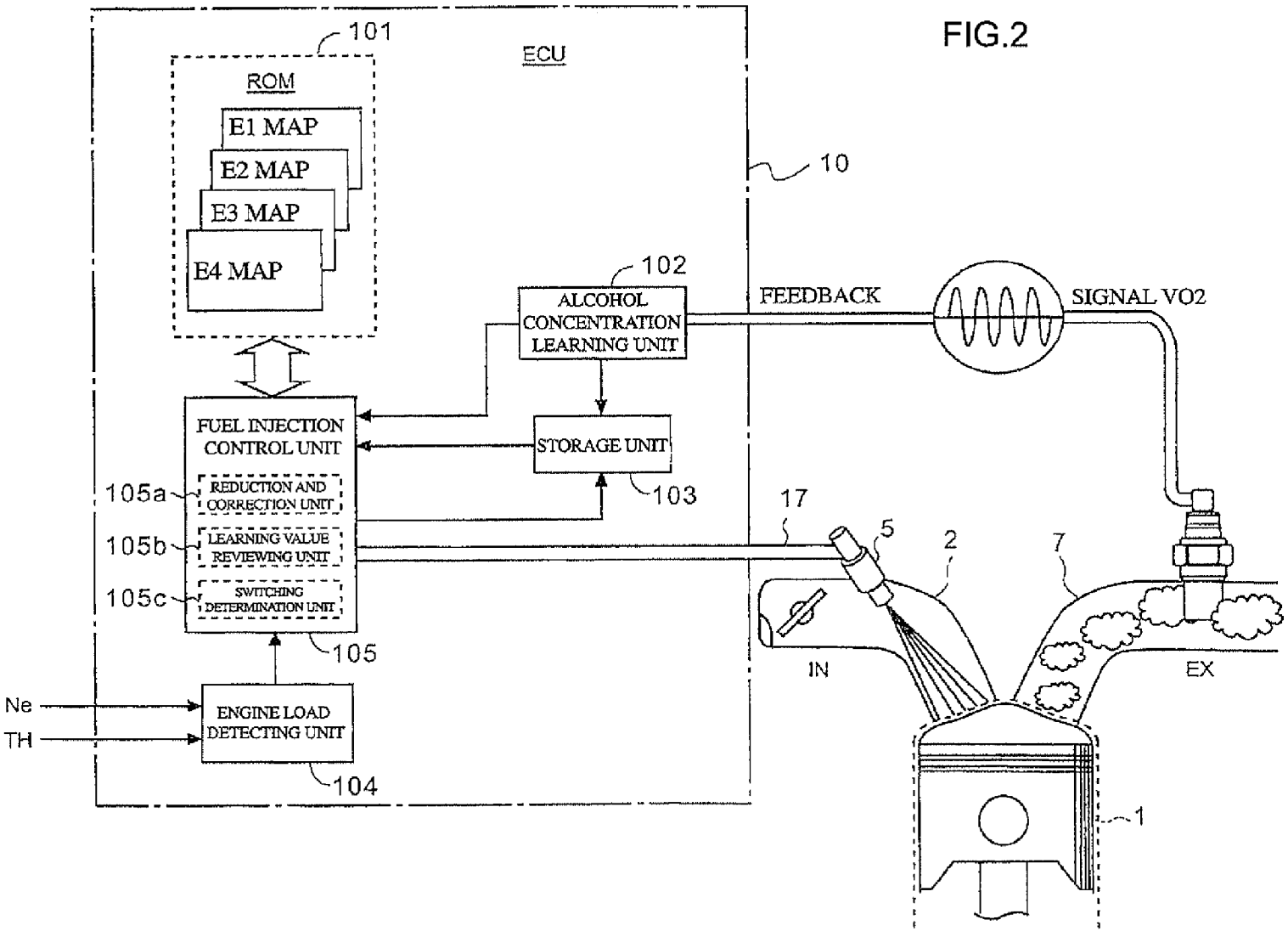
FIG. 2 is a block diagram functionally expressing a configuration for an ECU.

FIG. 2 is a functional block view showing a configuration for main essential parts for the ECU 10. Numerals that are the same as previously are used to denote identical or similar portions. Aspects of the configuration that are not necessary for explaining the embodiment of the present invention are not included in the drawings.

Figure 3:
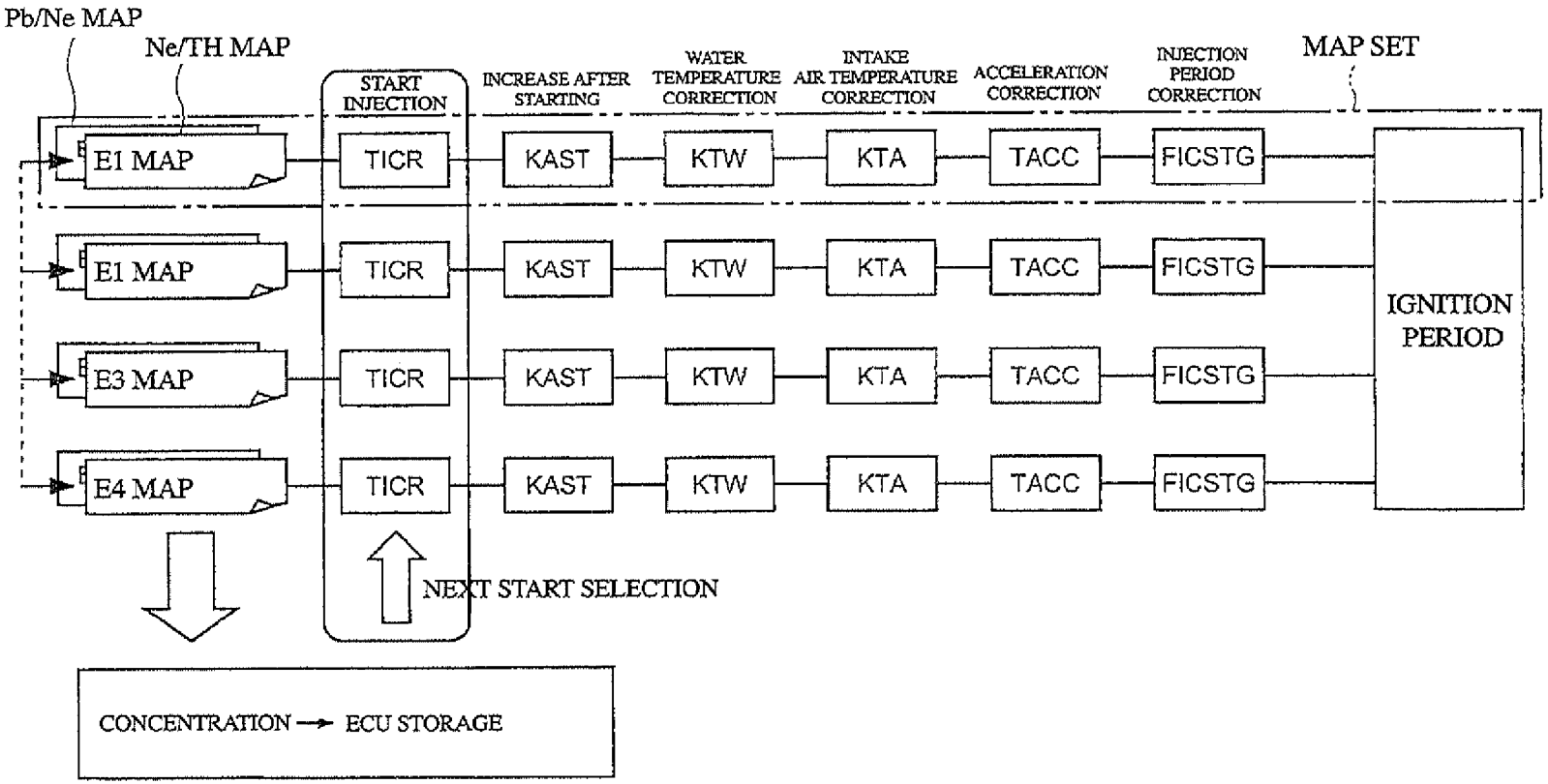
FIG. 3 is a view schematically expressing storage contents of a ROM.

A fuel injection map is stored in a ROM 101 each fuel alcohol concentration (hereinafter referred to as E concentration). FIG. 3 is a view schematically representing storage contents of the ROM 101. In this embodiment, a Pb/Ne map, an Ne/TH map, and various correction coefficient tables and start control information are stored in a mutually correlated manner each fuel ethanol concentration (E1, E2, E3, E4).

As described previously, the composition of the ethanol contains oxygen atoms. This means that the amount of oxygen required per unit volume for combustion is small compared to when gasoline is combusted. The theoretical air/fuel ratio is therefore smaller when a fuel that is a mixture of ethanol and gasoline is used than the case when fuel of just gasoline is used. It is therefore necessary to set injection control information each mixture ratio for the ethanol and the gasoline in order for the engine 1 to run in an optimum state.

On the other hand, when the ethanol is of a certain concentration, it is known from experimental results etc. that the same extent of control can be carried out as for when appropriate maps and tables for other concentrations are supplied as for with maps and tables for ensuring that the engine 1 runs in an optimum state even when another concentration is applied within a certain fixed range.

Figure 4:
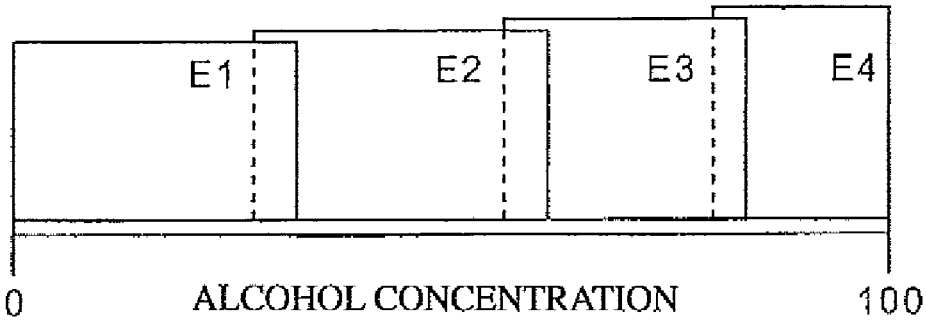
FIG. 4 is a view showing an example of a method for setting a range for ethanol concentration.

In this embodiment, as shown in the example in FIG. 4, a range for ethanol concentration is set and four types E1, E2, E3, E4 (where the alcohol concentration is E1<E2<E3<E4) are set in advance as reference concentrations for ethanol within respective ranges. A Pb/Ne map, an Ne/TH map, and various correction coefficient tables and start control information are then prepared in advance each respective reference concentration.

There may be any number of reference concentrations providing there are three or more that may be appropriately allocated to any concentration from 0% to 100%. The respective maps and tables are set to have ranges where concentrations overlap as shown in FIG. 4.

In this embodiment, sets of Pb/Ne maps, Ne/TH maps, various correction coefficient tables and start injection information prepared each ethanol reference concentration are denoted as "map sets", and there are also cases where map sets for each ethanol reference concentration are denoted as an E1 map set, an E2 map set, an E3 map set, and an E4 map set.

Returning to FIG. 2, an alcohol concentration learning unit 102 learns the E-concentration of the injected fuel based on a measured value (voltage) V02 of the $O_2$ sensor 15 representing the oxygen concentration within the exhaust pipe 7. The learning results are then repeatedly updated in a storage unit 103. An engine load detecting unit 104 detects current engine load based on the engine speed Ne and an extent of throttle opening TH.

At a fuel injection control unit 105, the reduction amount correction unit 105*a* reduces and corrects the amount of fuel injected for just a prescribed period when a learning value stored in the storage unit 103 is a high concentration (E3 or E in this embodiment). A learning value revising unit 105*b* revises learning values for the E-concentration based on the measured values of the $O_2$ sensor 15 during reduction and correction of the amount of fuel injected. A switching determination unit 105*c* determines whether or not the injected fuel has switched from the fuel remaining within a fuel pipe 17 to the fuel within the fuel tank.

When the engine is started and it is determined by the switching determination unit 105*c* that the injected fuel is switched over to the fuel within the fuel tank, when the learning value for the E-concentration stored in the storage unit 103 is a high concentration and the engine load detected by the engine load detection unit 104 is a prescribed high load state, the fuel injection amount control unit 105 reduces and corrects an amount of injected fuel obtained by referring to a fuel injection map according to the learning value. The fuel injection amount control unit 105 then ends the reduction and correction when the learning value is reviewed by the learning value reviewing unit 105*b* during reducing and correcting of the injected fuel.

Figure 5:
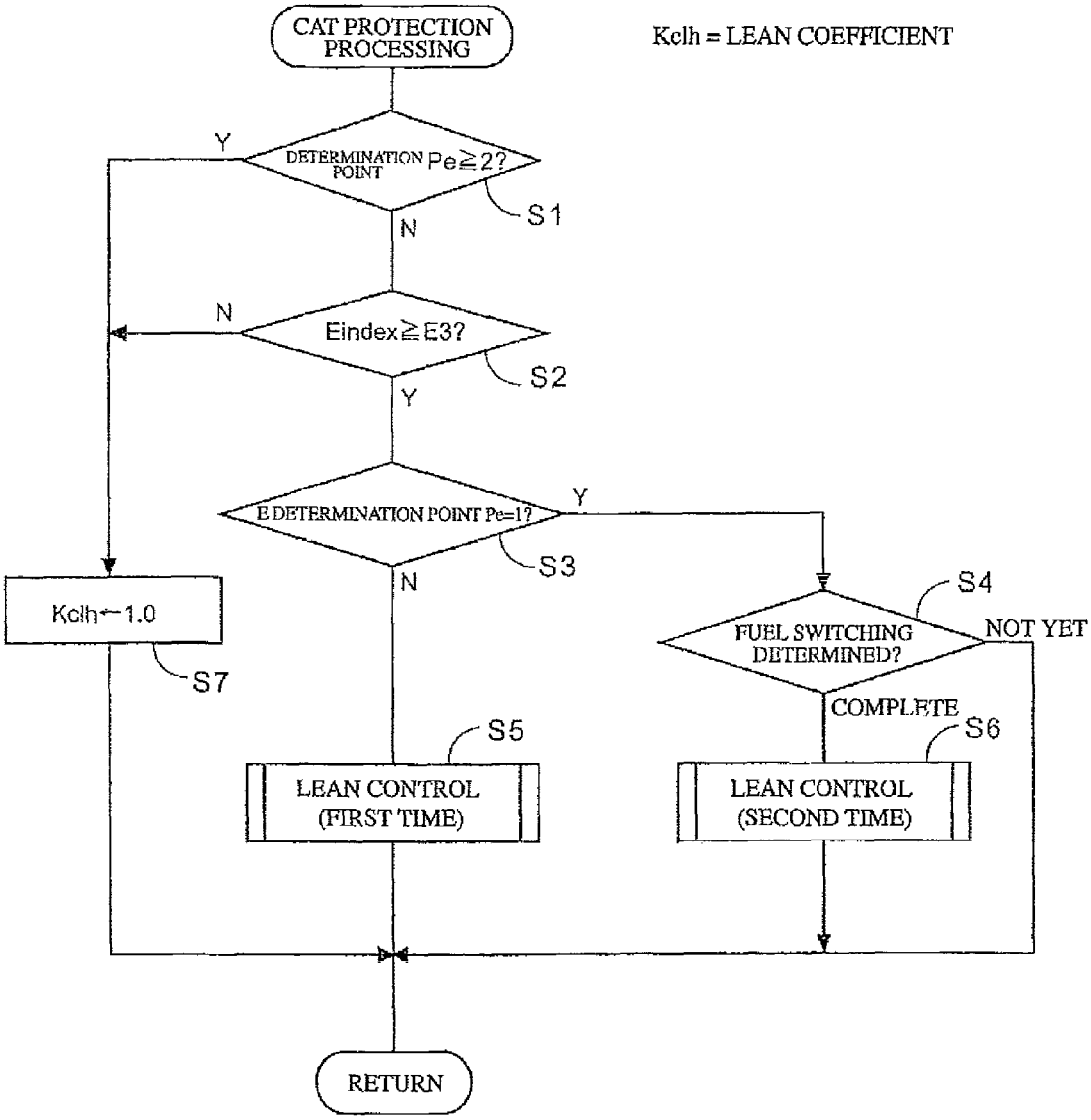
FIG. 5 is a main flowchart of a catalyzer (CAT) protection process, in which "Kclh" indicates a lean coefficient.
Figure 6:
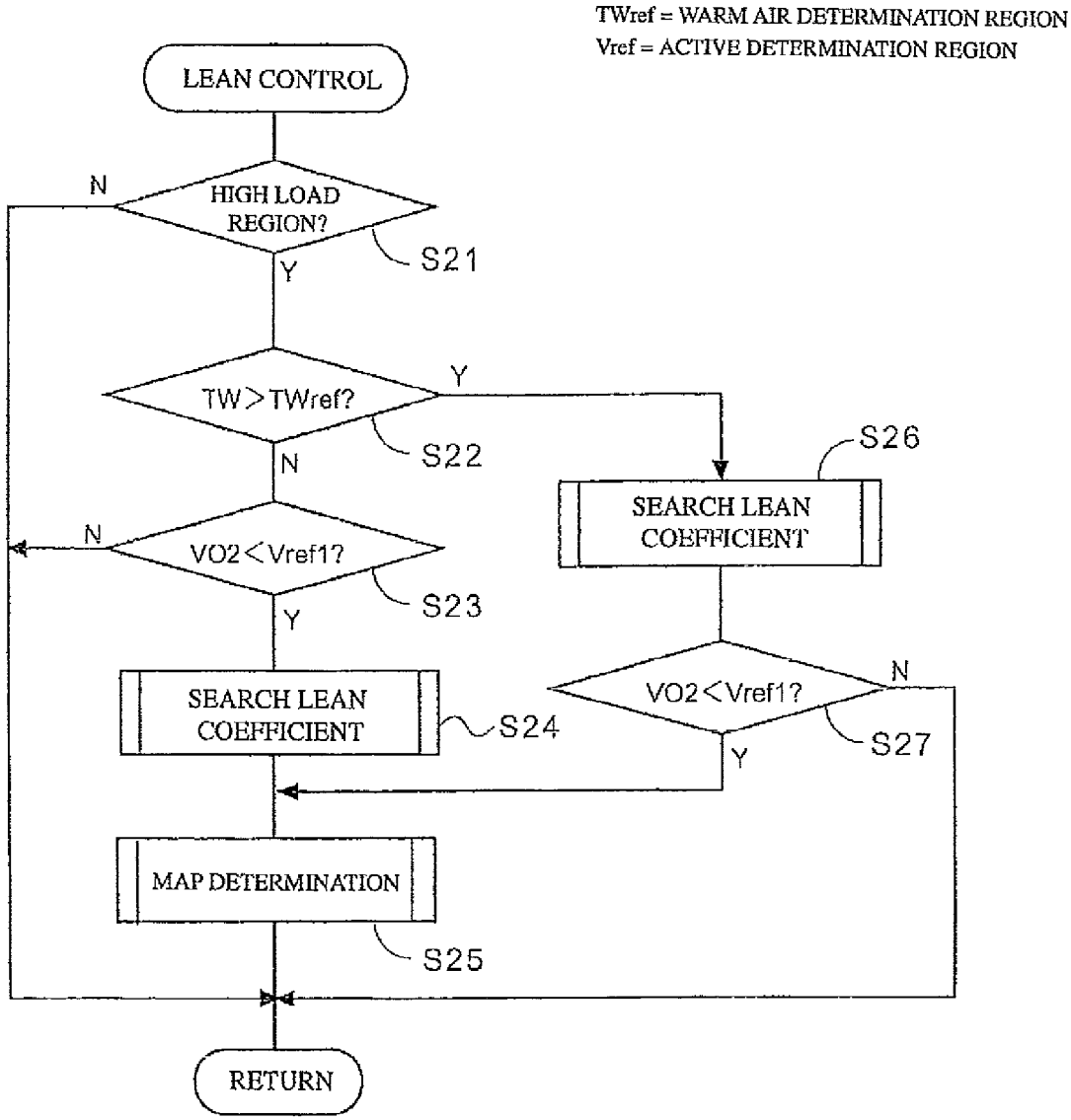
FIG. 6 is a flowchart showing a procedure for "lean control," in which "TWref" indicates a warm air determination region threshold value, and "Vref" indicates an active determination region threshold value.
Figure 8:
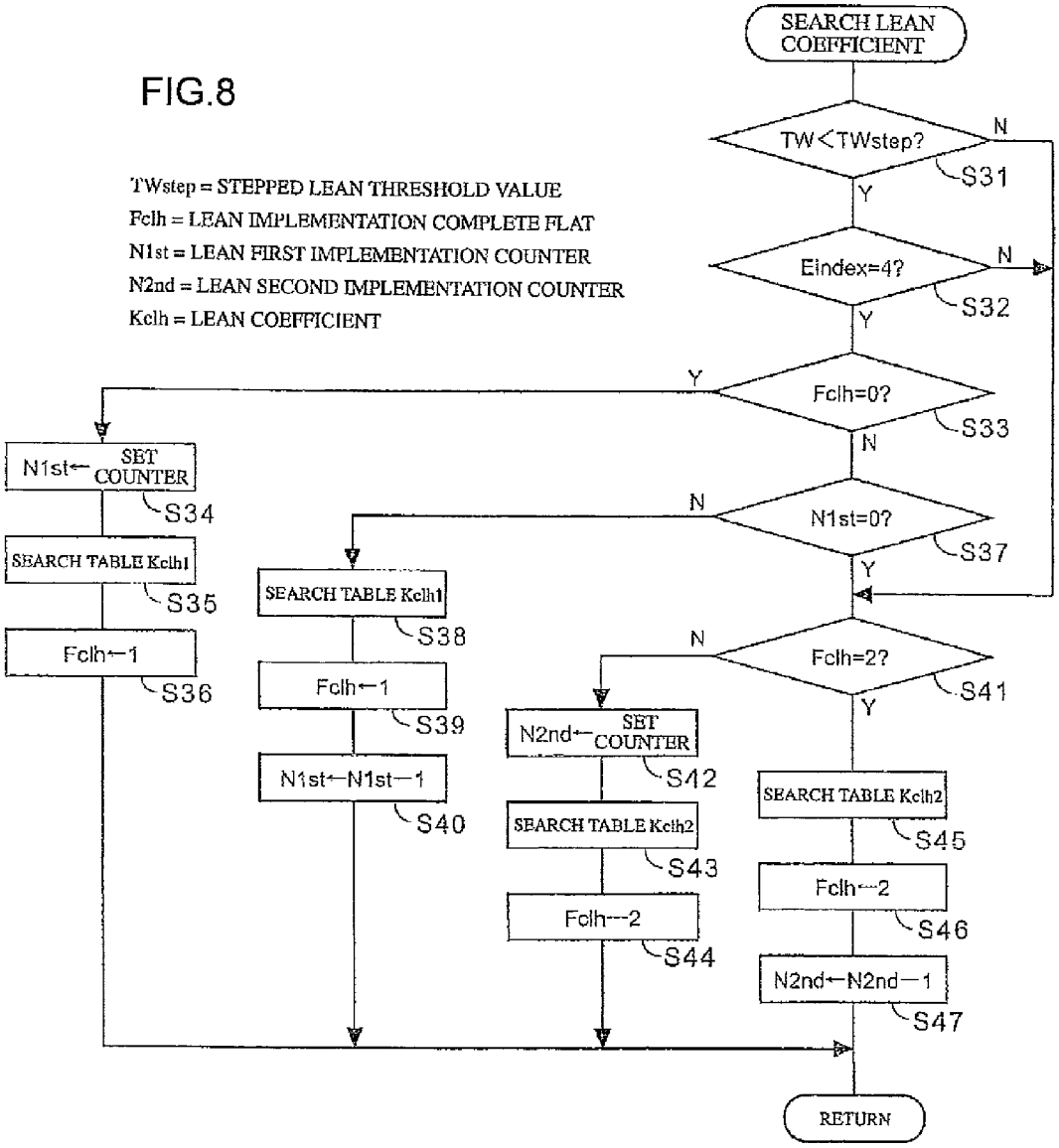
FIG. 8 is a flowchart showing a procedure for "lean coefficient search processing," in which "Twstep" indicates a stepped lean threshold value, "Fclh" indicates a lean implementation complete flag, "N1st" indicates a lean first implementation counter, "N2nd" indicates a lean second implementation counter, and "Kclh" indicates a lean coefficient.
Figure 10:
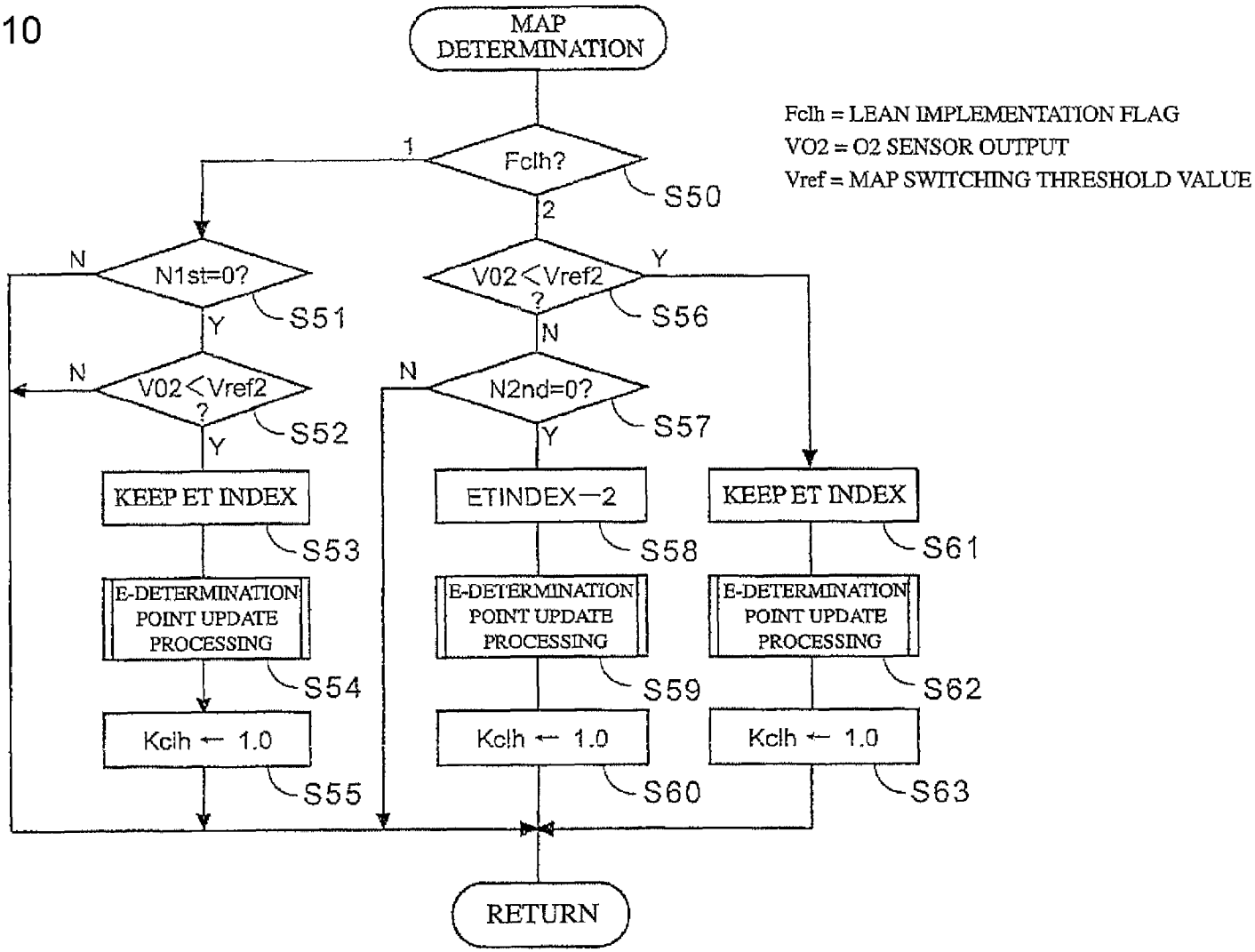
FIG. 10 is a flowchart showing a procedure for "MAP determination processing," in which "Fclh" indicates a lean implementation flag, "$VO_2$" indicates an $O_2$ sensor output, and "Vref" indicates a map switching threshold value.
Figure 11:
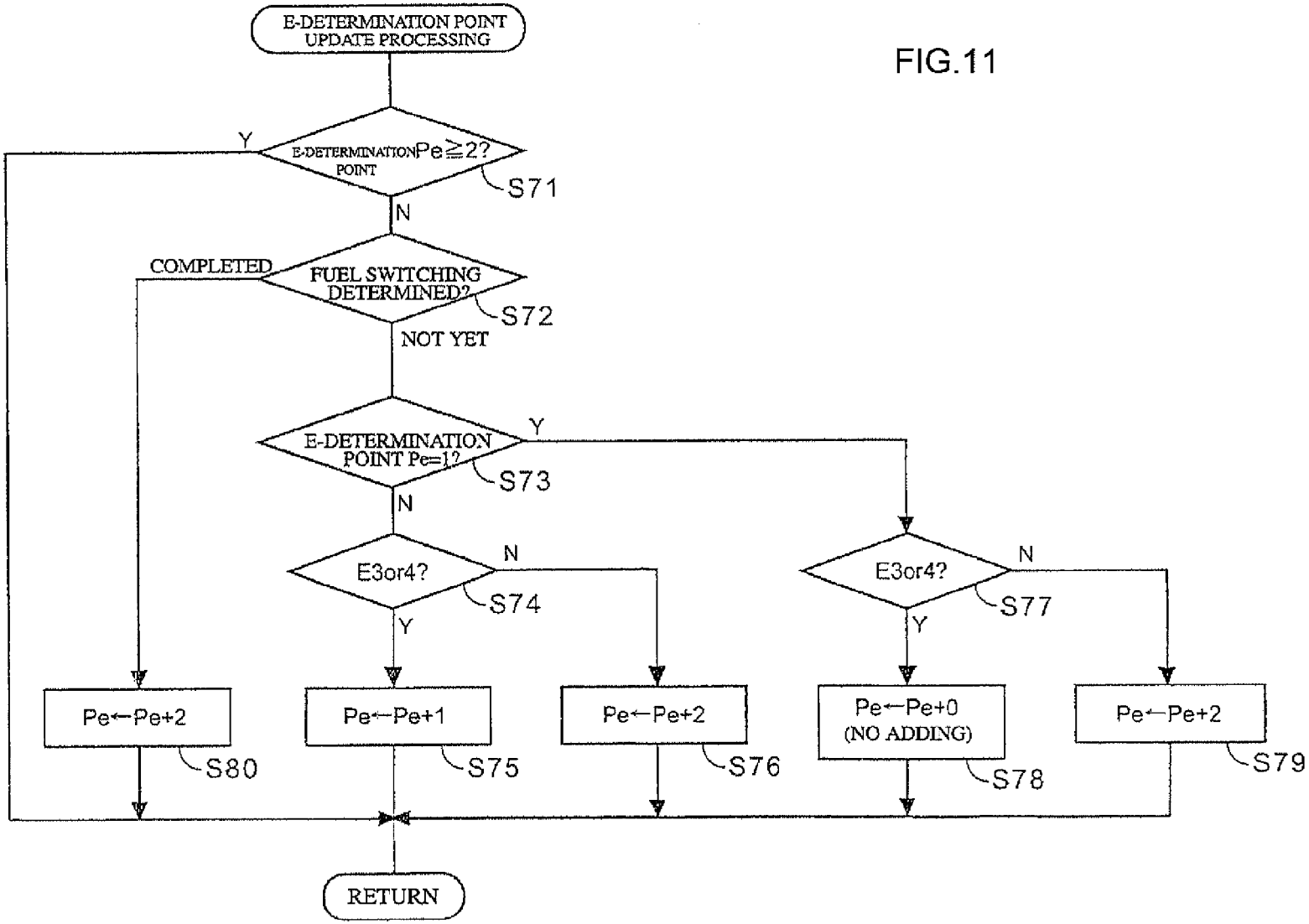
FIG. 11 is a flowchart showing a procedure for "E-determination point update processing"

A detailed description is now given of the operation of a first embodiment of the present invention while referring to a flowchart and a timing chart. FIG. 5 is a main flowchart showing a procedure for catalyzer (CAT) protection processing of a first embodiment of the present invention and mainly shows the operation of the ECU 10. FIG. 6 is a flowchart showing a procedure for "lean control" executed within the main flow. FIG. 8 and FIG. 10 are flowcharts showing procedures for "lean coefficient searching" and "MAP determination" executed within the respective "lean control". FIG. 11 is a flowchart showing a procedure for "E-determination point updating" executed within the "MAP determination".

Figure 13:
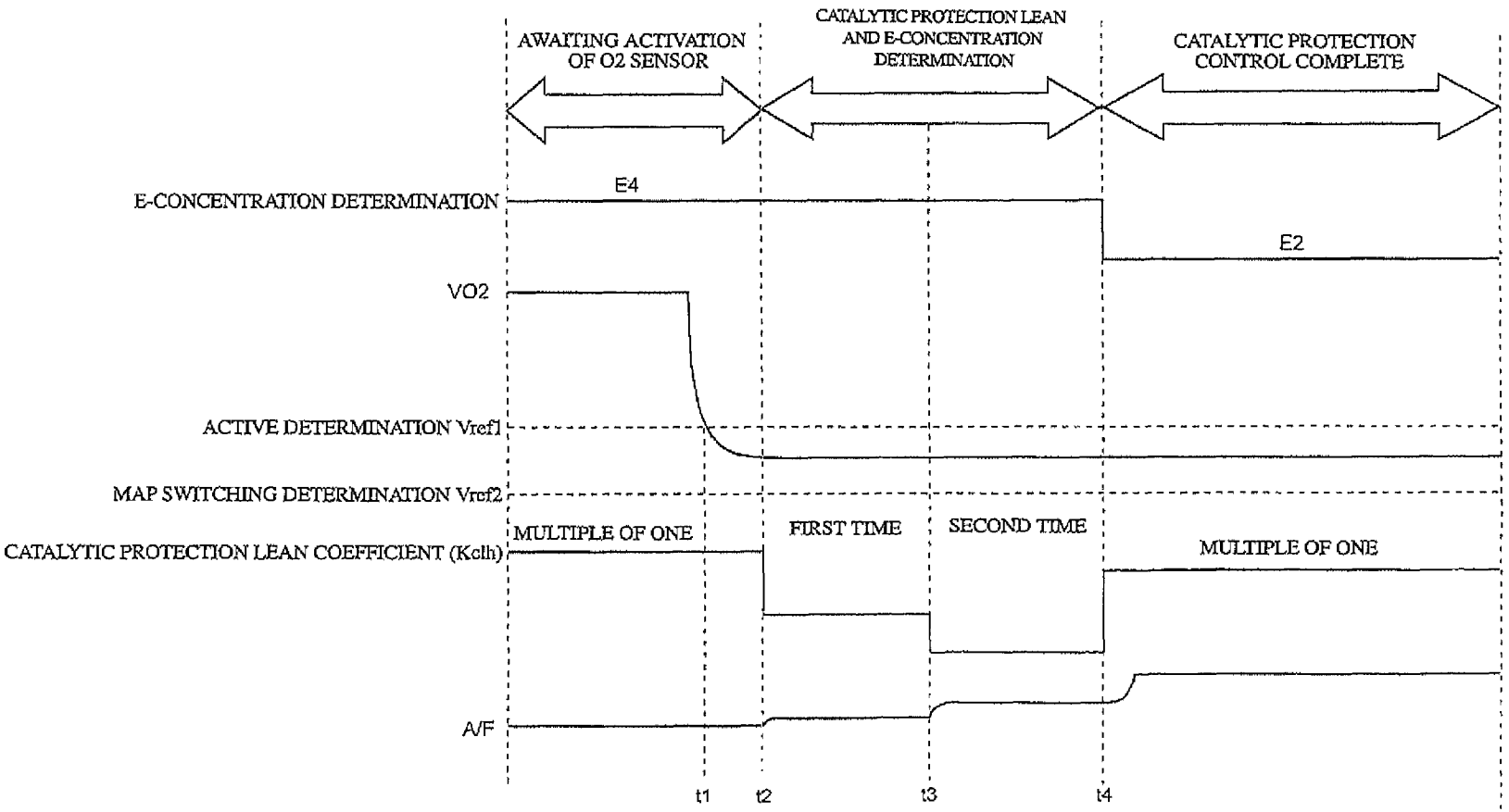
FIG. 13 is a timing chart showing lean control when alcohol concentration is changed from level E4 to level E2.

Here, first, the operation in the case where the engine is started in a state where the E-concentration within the fuel tank has fallen as far as the level E2 is described using a time series along the timing chart of FIG. 13 because gasoline is supplied during engine stopping regardless of whether the learning value for the E-concentration stored in the storage unit 103 (E-concentration learning value Eindex) is the level E4 of the highest concentration.

In step S1 of the main flow (FIG. 5), an E-determination (alcohol concentration determination) point Pe representing the alcohol concentration determination history is referred to. The CAT protection processing of this embodiment is only executed at a time (first time) immediately after the engine starts, and a time (second time) where it is estimated that all of the fuel within the fuel pipes (i.e. fuel of an alcohol concentration prior to refueling) has been consumed and injection of fuel within the fuel tank has commenced. Here, Pe represents the number of times of execution of the CAT protection processing has been completed. If it is determined that Pe≧2 in step S1, it is determined that the CAT protection processing has already been executed two times. Step S7 is then proceeded to, a lean (dilution) coefficient Kclh is returned to an initial value of "1.0" (i.e. the fuel is not made lean) and the processing ends.

On the other hand, an initial value for the E-determination point Pe is "0". It is therefore determined that Pe<2 immediately after starting the engine and step S2 is proceeded to. In step S2, the E-concentration learning value Eindex stored in the storage unit 103 is referred to. When the E-concentration learning value Eindex is a low concentration level (E1, E2), step S7 is proceeded to, the lean coefficient Kclh is returned to the initial value "1.0", and the processing ends. Namely, in this embodiment, lean control is not executed when the E-concentration learning value Eindex is a low concentration and the amount of fuel injected is relatively small.

With regards to this, if the stored learning value Eindex is a high concentration such as level E4 or level E3 as in this embodiment, quantity reduction and correction is carried out by multiplying the fuel injection amount Tout with the lean coefficient Kclh. As a result, step S3 where the air/fuel ratio is to be made lean is proceeded to. In step S3, the E-determination point Pe is referred to anew. If the E-determination point Pe is other than "1" (i.e. Pe=0), step S5 is proceeded to. If the E-determination point is "1", step S4 is proceeded to. Pe=0 directly after the engine starts. Step S5 is then proceeded to, and first time "lean control" is executed.

Figure 7:
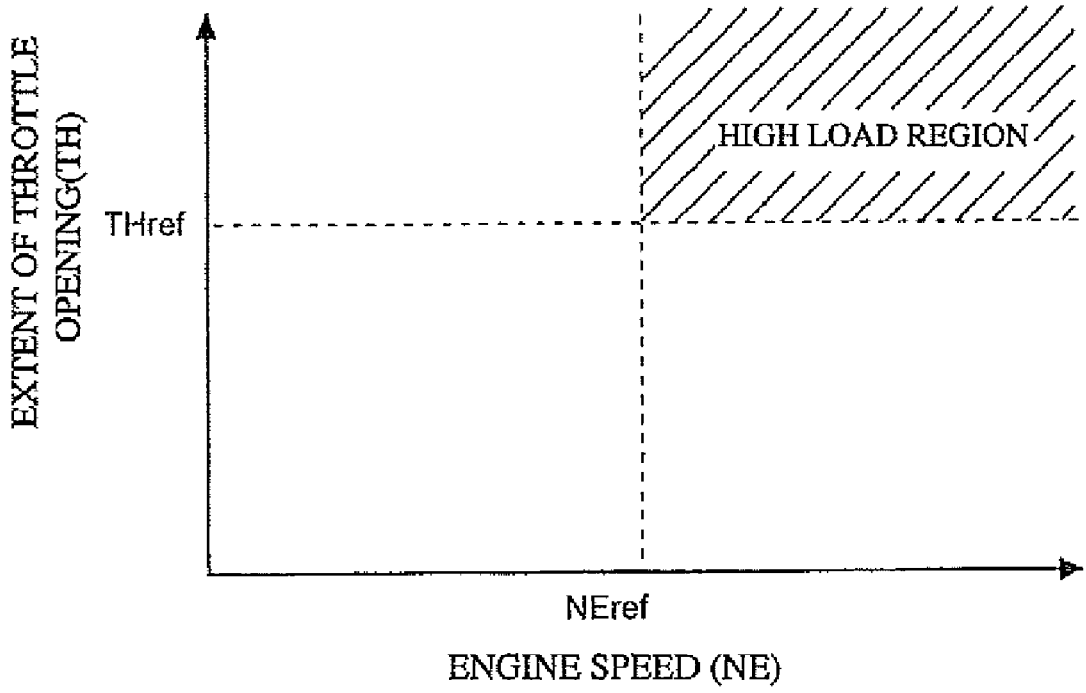
FIG. 7 is a diagram showing conditions for determining that running conditions are in a high load region.

FIG. 6 is a flowchart showing a procedure for the "lean control". In step S21, it is determined whether or not a running state of the engine is in a high load region constituting a target of the CAT protection control based on the extent of opening of the throttle TH and the engine speed NE. In this embodiment, as shown in FIG. 7, if the extent of opening the throttle TH is greater than a prescribed reference extent of opening THref and the engine speed NE is greater than a prescribed reference speed NEref, the CAT protection control is determined to be a required high load region. Step S22 is then proceeded to. If the region is not a high load region, the processing ends.

In step S22, a cooling water temperature TW is compared with a warm up determination threshold value TWref. If TW>TWref, it is determined that the warm up has ended and "searching for a lean coefficient" of step S26 is proceeded to. If TW≦TWref, it is determined that this is prior to warm up. Step S23 is then proceeded to and a measurement value V $O_2$ of the $O_2$ sensor 15 is compared with an active determination threshold value Vref1. If this is before the time T1 of FIG. 13, then V02≧Vref1 and it is determined that the $O_2$ sensor 15 is not-yet active and the processing therefore ends. With regards to this, if V $O_2$<Vrefe1 at time t1 and activation of the $O_2$ sensor 15 is complete, step S24 is proceeded to and a "lean coefficient search" is executed.

In this embodiment, before warming up of the engine, the $O_2$ sensor 15 becoming active is awaited in order to ensure drivability immediately after starting and a lean coefficient search (step S24) is executed. After warming up, the lean coefficient search (step S26) is executed from before the $O_2$ sensor 15 becoming active.

FIG. 8 is a flowchart showing a procedure for the "lean coefficient search". Here, an optimum lean coefficient Kclh is searched based on the cooling water temperature TW.

In step S31, the cooling water temperature TW and a prescribed threshold value TWstep are compared in order to determine whether the injected fuel is made lean in stages (in this embodiment, two stages) or all in one go. If TW<TWstep, step S32 is proceeded to in order to make the fuel lean in stages. If TW≧TWstep, step S41 is proceeded to in order to make the fuel lean in one go.

In step S32, it is determined whether or not the current E-concentration learning value Eindex is a high concentration level E4. If Eindex is the level E4, step S33 is proceeded to in order to make the fuel lean in two stages. If Eindex is not the level E4, step S41 is proceeded to in order to make the fuel lean in one go. In this embodiment, the E-concentration learning value Eindex is determined to be the level E4. Step S33 is therefore proceeded to in order to execute the process of making the fuel lean from the first stage.

Figure 9:
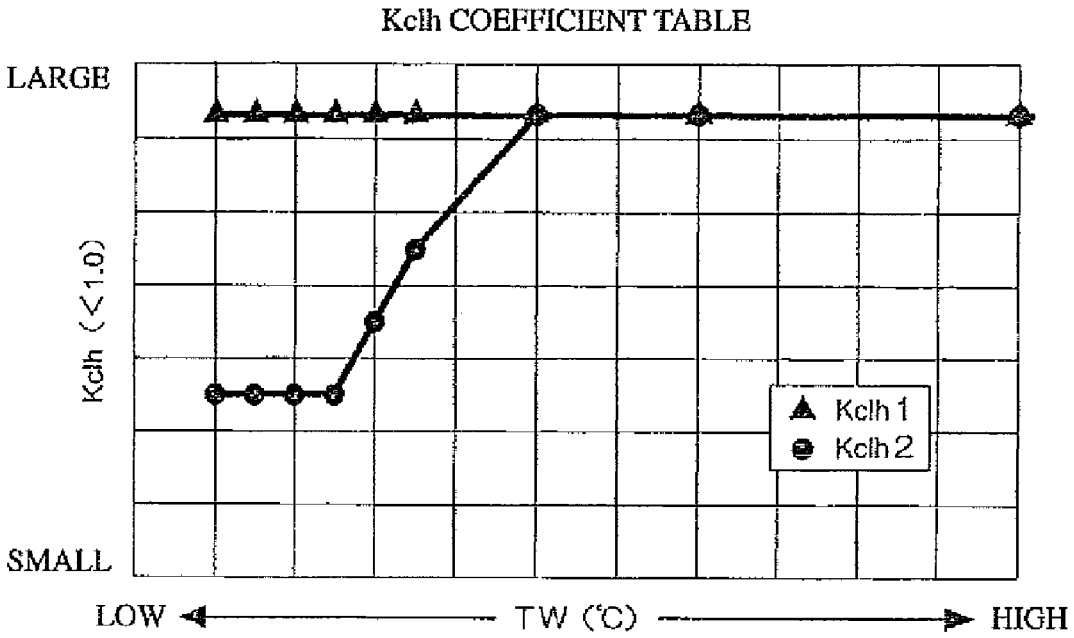
FIG. 9 is a view showing an example of first and second coefficient tables (E4)

In step S33, a lean execution complete flag Fclh is referred to. Step S34 is then proceeded to because the flag Fclh is in the reset state (prior to making lean). In step S34, a prescribed count value is set to the first counter N1st that decides a period of implementation for the first stage of making fuel lean. In step S35, a first stage lean coefficient Kclh1 (<1.0) is searched from a first coefficient table correlated with the current E-concentration learning value Eindex (which here is E4) taking the cooling water temperature TW as a parameter. FIG. 9 is a view showing an example of the first coefficient table where the first stage lean coefficient Kclh1 corresponding to the current cooling water temperature TW is recorded at a time t2. In step S36, a lean execution complete flag Fclh is set to "1".

As a result, the lean coefficient Kclh is multiplied with the fuel injection amount Tout calculated separately at the fuel injection amount control unit 105 by the reducing of correcting unit 106 so that amount of fuel injected is reduced. The air/fuel ratio therefore rises at the time t2 as shown in FIG. 13. As shown above, when retrieval of the lean coefficient search of step S24 (or step S26) is complete, step S25 of FIG. 6 is proceeded to and the MAP determination processing is implemented.

FIG. 10 is a flowchart showing a procedure for the "MAP determination processing". The E-concentration learning value Eindex is then revised based on the output V02 OF THE $O_2$ sensor 15.

In step S50, a lean execution flag Fclh is referred to. In this case it is determined that Fc the lh=1 (first stage) and step S51 is therefore proceeded to. In step S51, the first stage counter N1st is referred to and the main flow is immediately returned to until the first stage counter N1st times out and the first stage of making lean is complete.

Each of the processes described above are then repeated after this so that in the next "lean coefficient search process" (FIG. 8), in step S33, the lean execution flag Fclh is determined to be "1" and step S37 is proceeded to. In step S37, the first stage counter N1st is referred to and step S38 is proceed to up until the counter N1st times out. In step S38, as in step S35, the first stage lean coefficient Kclh1 is retrieved from the first coefficient table correlated with the current E-concentration learning value Eindex taking the cooling water temperature TW as a parameter. In this embodiment, the lean coefficient Kclh1 of the first coefficient table is fixed regardless of the cooling water temperature TW and the same value as for the previous time is therefore set. In step S39, as in step S36, the lean execution flag Fclh1 is set to "1". The first stage current N1st is then decremented in step S40.

After this, at time t3 of FIG. 13, when the first stage counter N1st times out and this is detected by step S51 of FIG. 10, step S52 is proceeded to. In step S52, the $O_2$ sensor output V02 and the MAP switching threshold value Vref2 are compared in order to confirm the validity of the current E-concentration learning value Eindex. Here, it is determined that the sensor output V02 exceeds the MAP switching threshold value Vref2 and the E-concentration learning value Eindex is not valid. A revision of the E-concentration learning value Eindex is then sent in advance to the second stage leaning.

After this, when timing out of the first stage counter N1st is also detected in step S37 of FIG. 8, the first stage of making leaner is complete, and step S41 is proceeded to in order to proceed to the second stage. In step S41, the lean execution flag Fclh is referred to and step S42 is then proceeded to because that other than "2" is determined. In step S42, a prescribed count value is set to the second stage counter N2nd that decides the implementation period for the second stage of making lean. In step S43, a second stage lean coefficient clh2 is retrieved from the second coefficient table, an example of which is shown in FIG. 9, taking the cooling water temperature TW as a parameter. In step S44, a lean execution complete flag Fclh is set to "2".

As a result, a second stage lean coefficient Kclh2 that is smaller than the first stage lean coefficient Kclh1 is multiplied with the fuel injection amount Tout. The amount of fuel injected is therefore further reduced and the air/fuel ratio rises further upon the time t3 as shown in FIG. 13. As shown above, when the "lean coefficient searching" ends, FIG. 6 is again returned to and the "MAP determination processing" (FIG. 10) is again executed in step S25.

In step S50 of FIG. 10, the lean execution flag Fclh is referred to and step S56 is proceeded to because a determination of Fclh=2 is made here. In step S56, the $O_2$ sensor output V02 and the MAP switching threshold value Vref2 are compared in order to confirm the validity of the current E-concentration learning value Eindex. Here, the sensor output V02 exceeds the MAP switching threshold value Vref2 and the current E-concentration learning value Eindex therefore cannot be determined to be valid. Step S57 is then proceeded to. In step S57, the second stage counter N2nd is referred to, and the main flow (FIG. 5) is returned to immediately up until the counter N2nd times out.

After this, the second counter N2nd times out at the time t4 of FIG. 13 and step S58 is proceeded to when this is detected in step S57 shown in FIG. 10. In step S58, the current E-concentration learning value Eindex is shifted by just the second stage to the low E side. Namely, if the current E-concentration learning value Eindex is the level E4, the level E2 is switched over to. The "E-determination point updating processing" is then executed in step S59.

FIG. 11 is a flowchart showing a procedure for E-determination point update processing. In step S71, the current E-determination point Pe is referred to and it is determined here that Pe<2. Step S72 is therefore proceeded to. In step S72, it is determined whether or not switching over from the injected fuel being from fuel within the piping to fuel from within the fuel tank is complete.

Figure 12:
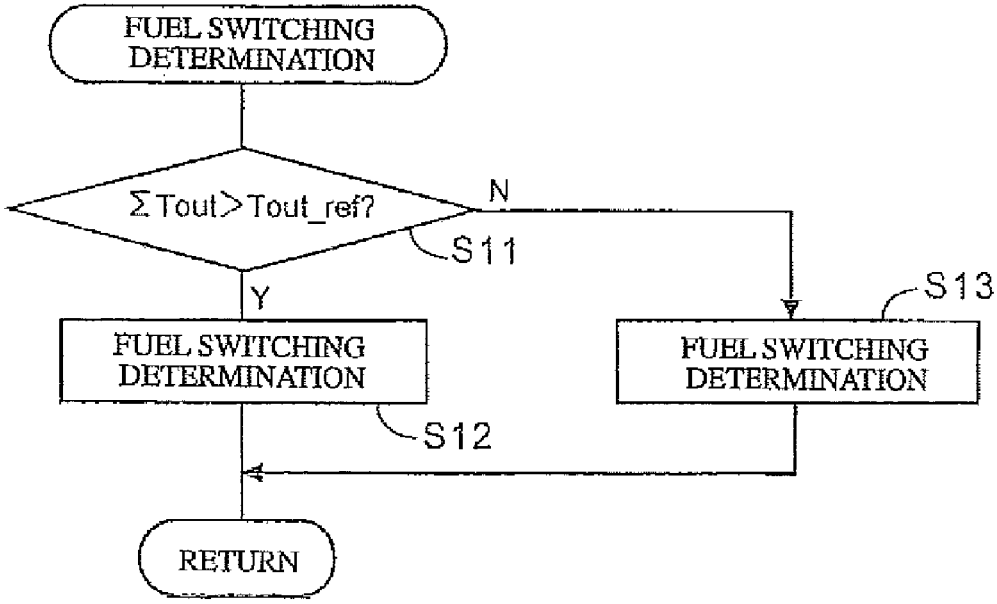
FIG. 12 is a flowchart showing a procedure for "fuel switching determination processing," in which "ΣTout" indicates an integral of a fuel injection mount, and "Tout_ref" indicates a fuel switching threshold value.

FIG. 12 is a flowchart showing a procedure for a "fuel switching determination" executed separately in the background of the CAT protection processing. In step S11, an integral value ΣTout for the fuel injection amount Tout for after starting the engine is compared with the fuel switching threshold value Tout_ref. The fuel switching reference value Tout_ref is set to a value capable of determining that all of the fuel remaining at the fuel pipe 17 has been injected. If ΣTout>Tout_ref, step S12 is proceeded to and it is taken that fuel switching is complete. On the other hand, if ΣTout≦Tout_ref, step S13 is proceeded to and it is taken that fuel switching has not yet been achieved.

Returning to FIG. 11, it has been determined that fuel switching has not yet been achieved immediately after starting of the engine. Step S74 is therefore proceeded to because it is determined that Pe=0 and the current E-concentration learning value Eindex is determined. This is already E2 and as this is determined to be other than E3 and E4, step S76 is proceeded to. In step S76, the E-determination point Pe is updated by just "+2".

If the E-determination point Pe is "2", in the main flow of FIG. 5, it is determined in S1 that Pe≧2. The lean coefficient Kclh is therefore returned to "1.0" in step S7 and the control ends.

Figure 14:
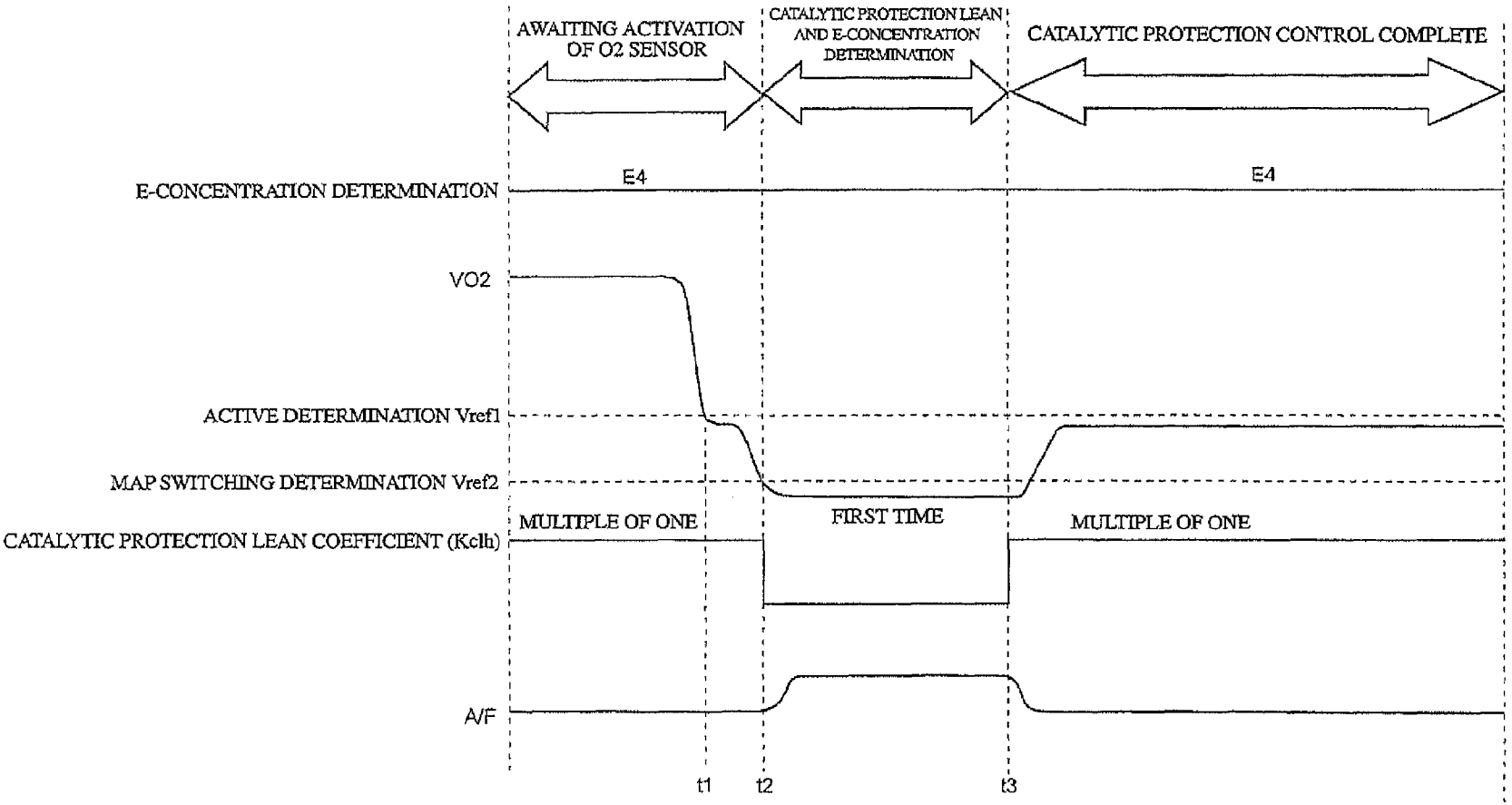
FIG. 14 is a timing chart showing lean control when the alcohol concentration is maintained at level E4.

Next, the operation in the case where the E-concentration learning value Eindex stored in the storage unit 103 is a high concentration level E4 and remains the level E4 even for the alcohol concentration within the fuel tank the next time that the engine starts is described using a time series with reference to the time chart of FIG. 14 and each of the flowcharts. If the stored E-concentration learning value Eindex is the high-concentration level E4, in step S35 for the lean coefficient search (FIG. 8), the first stage lean coefficient Kclh1 is similarly recorded. As a result, the lean coefficient Kclh is multiplied with the fuel injection amount Tout calculated separately by the fuel injection amount control unit 105 and the amount of fuel injected is therefore reduced. The air/fuel ratio therefore rises upon the time t2 in the example shown in FIG. 14. The first stage of making lean is then continued until the first stage counter N1st times out.

After this, at a time t3, the first stage counter N1st times out. Step S52 is then proceeded to when this is detected in step S51 of the MAP determination processing (FIG. 10). In step S52, the $O_2$ sensor output V02 and the MAP switching threshold value Vref2 are compared in order to confirm the validity of the current E-concentration learning value Eindex. Here, the sensor output V02 is less than the MAP switching threshold value Vref2. It is therefore determined that the current E-concentration learning value Eindex is valid. Step S53 is then proceeded to and the current E-concentration learning value Eindex (E4) is maintained. The "E-determination point updating processing" is then executed in step S54.

In the "E-determination point (Pe) updating processing of FIG. 11, in step S71, it is determined that the current E-determination point Pe is "0" and step S72 is proceeded to. In step S72, it is determined whether or not the fuel switching is complete. It is then determined that fuel switching over is not yet complete after starting of the engine. Step S73 is therefore proceeded to and the current E-determination point Pe is determined Step S74 is therefore proceeded to because Pe=0 and the current E-concentration learning value Eindex is determined Step S75 is then proceeded to because E4 is determined here. The E-determination point Pe is then updated by "+1" and Pe=1.

Returning to FIG. 10, in step S55, the lean coefficient Kclh is returned to "1.0". Therefore, as shown in FIG. 14, the air/fuel ratio falls at the time t3. If the E-determination point Pe is updated, in the main flow of FIG. 5, step S4 is proceeded to from step S3. Switching over from the fuel within the fuel pipes to the fuel within the fuel tank is then awaited and lean control is then similarly executed a second time.

In the above embodiments, a description is given where temperature of the engine is exemplified by water temperature but temperature of the engine can also be exemplified by oil temperature when an oil temperature sensor is provided.

In this embodiment, in the first time lean control, if the results of the determination for the E-concentration learning value Eindex are still a high concentration level (E4, E3), lean control is implemented a second time. On the other hand, if the results of the determination for the E-concentration learning value Eindex have changed to a low concentration level (E2, E1), the lean control is not implemented a second time. Further, in this embodiment, in the lean control the first and second times, lean control is only implemented a second time when the validity of the current E-concentration learning value Eindex cannot be confirmed when making lean the first time. If the validity of the E-concentration learning value Eindex can be confirmed when making lean the first time, making lean the second time can be omitted.

(1) According to an embodiment of the present invention, an oxygen concentration sensor that detects concentration of oxygen within an exhaust gas, an alcohol concentration learning unit that learns alcohol concentration of the injected fuel based on a value calculated by the oxygen concentration sensor, an alcohol concentration storage unit that stores learning values for the alcohol concentration, and a fuel injection amount control unit that controls an amount of fuel injected based on a learning value are provided. The fuel injection amount control unit includes a reduction and correction unit that reduces and corrects the amount of fuel injected so as to be less than the injection amount corresponding to the read out learning value, and a reviewing unit that reviews the learning values based on values calculated by the oxygen concentration sensor during reduction and correction. The amount of fuel injected is reduced and corrected by just a prescribed period by the reduction and correction unit when the read out learning value is for a high concentration when the engine is starting, with the amount of fuel injected then being controlled thereafter based on the reviewed learning value.

(2) According to an embodiment of the present invention, a determining unit that determines whether or not the injected fuel has switched over from fuel remaining within a fuel pipe to fuel within a fuel tank is also provided. The fuel injection amount control unit reduces and corrects the amount of fuel injected by just a prescribed amount using the reduction and correction unit when the injected fuel switches over to the fuel within the fuel tank, with the amount of fuel injected being controlled thereafter based on the reviewed learning value.

(3) According to an embodiment of the present invention, the fuel injection amount control unit reduces and corrects the amount of fuel injected when the read out learning value is for a high concentration and the running state of the engine is in a high load region.

(4) According to an embodiment of the present invention, the reduction and correction of the amount of fuel injected can also be carried out in stages.

According to the embodiments of the present invention, the following results are achieved.

(1) When the engine starts up, when the learning value stored in relation to alcohol concentration of fuel is high, the amount of fuel injected is reduced and corrected until reviewing of this learning value is complete. This means that it is possible to prevent the air/fuel ratio from becoming over-rich even if actual alcohol concentration falls below the learning value in order to supply fuel of a low alcohol concentration during stopping. It is therefore possible to prevent a load on a catalyzer from becoming large.

(2) It is also possible to reduce and correct the amount of fuel injected until reviewing of a learning value is complete not only when the engine is starting up, but also at the time of switching the injected fuel from fuel remaining within a fuel pipe to fuel within the fuel tank. It is therefore possible to prevent the learning value from being reviewed based on supplied fuel that remains in the fuel pipe.

(3) The reduction and correction of the injected fuel is only carried out when the learning value is for a high concentration and the running state of the engine is for a high load region. It is therefore possible to prevent reduction and correction from being implemented under conditions where protection of the catalyzer is not necessary.

(4) The reduction and correction of the injected fuel can also be carried out in stages. It is therefore possible to prevent the injected fuel from being excessively reduced and corrected. Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A fuel injection control device for a multi-fuel engine, comprising:

an oxygen concentration sensor configured to detect an oxygen concentration in an exhaust gas;

an alcohol concentration learning unit configured to learn an alcohol concentration in an injected fuel based on the oxygen concentration detected by the oxygen concentration sensor;

an alcohol concentration memory configured to store a learning value corresponding to the oxygen concentration;

a fuel injection amount controller configured to control a fuel injection amount based on the learning value;

a corrector configured to reduce the fuel injection amount corresponding to the learning value for a predetermined time period when the learning value is higher than a threshold value when an engine is started; and a reviewer configured to review the learning value to provide a revised learning value based on the oxygen concentration while the corrector reduces the fuel injection amount, the fuel injection amount being controlled based on the revised learning value after the corrector reduces the fuel injection amount.

2. The fuel injection control device for a multi-fuel engine according to claim 1, further comprising:

a determining unit configured to determine whether or not the injected fuel is switched from a fuel having been within a fuel pipe to a fuel having been within a fuel tank, wherein the corrector reduces the fuel injection amount when the determining unit determines that the injected fuel is switched from the fuel having been within the fuel pipe to the fuel having been within the fuel tank.

3. The fuel injection control device for a multi-fuel engine according to claim 2, wherein the corrector reduces the fuel injection amount for the predetermined time period when the learning value is higher than the threshold value and a running state of the engine is in a high load region.

4. The fuel injection control device for a multi-fuel engine according to claim 2, wherein the corrector reduces the fuel injection amount in stages.

5. The fuel injection control device for a multi-fuel engine according to claim 1, wherein the corrector reduces the fuel injection amount for the predetermined time period when the learning value is higher than the threshold value and a running state of the engine is in a high load region.

6. The fuel injection control device for a multi-fuel engine according to claim 5, wherein the corrector reduces the fuel injection amount in stages.

7. The fuel injection control device for a multi-fuel engine according to claim 1, wherein the corrector reduces the fuel injection amount in stages.

8. A fuel injection control method for a multi-fuel engine comprising:

detecting an oxygen concentration in an exhaust gas;

learning an alcohol concentration in an injected fuel based on the oxygen concentration;

storing a learning value corresponding to the oxygen concentration;

controlling a fuel injection amount based on the learning value;

reducing the fuel injection amount corresponding to the learning value for a predetermined time period when the learning value is higher than a threshold value when an engine is started; and reviewing the learning value to provide a revised learning value based on the oxygen concentration while the fuel injection amount is reduced, the fuel injection amount being controlled based on the revised learning value after the fuel injection amount is reduced.

9. A fuel injection control device for a multi-fuel engine comprising:

means for detecting an oxygen concentration in an exhaust gas;

means for learning an alcohol concentration in an injected fuel based on the oxygen concentration detected by the means for detecting;

means for storing a learning value corresponding to the oxygen concentration;

means for controlling a fuel injection amount based on the learning value;

correction means for reducing the fuel injection amount corresponding to the learning value for a predetermined time period when the learning value is higher than a threshold value when an engine is started; and means for reviewing the learning value to provide a revised learning value based on the oxygen concentration while the correction means reduces the fuel injection amount, the fuel injection amount being controlled based on the revised learning value after the correction means reduces the fuel injection amount.

* * * * *